US008284008B2

(12) United States Patent
Koh

(10) Patent No.: US 8,284,008 B2
(45) Date of Patent: Oct. 9, 2012

(54) MULTIPLE COILS FLUORESCENT LAMP BALLAST

(76) Inventor: Eng Siang Koh, Pulau Pinang (MY)

( * ) Notice: Subject to any disclaimer, the term of this patent is extended or adjusted under 35 U.S.C. 154(b) by 79 days.

(21) Appl. No.: 12/895,338

(22) Filed: Sep. 30, 2010

(65) Prior Publication Data

US 2011/0018666 A1 Jan. 27, 2011

Related U.S. Application Data

(63) Continuation of application No. PCT/MY2008/000023, filed on Apr. 1, 2008.

(51) Int. Cl.
*H01F 17/06* (2006.01)
*H01F 27/02* (2006.01)
*H01F 27/24* (2006.01)

(52) U.S. Cl. ..... 336/178; 336/92; 336/212

(58) Field of Classification Search ..... 336/90, 336/92, 211, 212, 213, 216, 217, 221
See application file for complete search history.

(56) References Cited

U.S. PATENT DOCUMENTS

| | | | | | |
|---|---|---|---|---|---|
| 2,293,951 | A | * | 8/1942 | Seastone et al. | 336/216 |
| 2,887,242 | A | | 5/1959 | Grau | |
| 2,936,433 | A | * | 5/1960 | Smith | 336/215 |
| 3,010,185 | A | * | 11/1961 | Hume | 29/606 |
| 3,038,135 | A | * | 6/1962 | Feinberg | 336/165 |
| 3,153,215 | A | * | 10/1964 | Burkhardt et al. | 336/217 |
| 3,169,235 | A | * | 2/1965 | Ouletta | 336/210 |
| 3,302,017 | A | * | 1/1967 | Cornell et al. | 362/368 |
| 3,873,910 | A | * | 3/1975 | Willis, Jr. | 323/339 |
| 4,654,563 | A | * | 3/1987 | Boyd | 315/244 |
| 4,711,019 | A | * | 12/1987 | Albeck et al. | 29/609 |
| 4,940,921 | A | * | 7/1990 | Helling et al. | 315/219 |
| 5,477,439 | A | * | 12/1995 | Kowalenko et al. | 362/260 |
| 6,445,270 | B1 | * | 9/2002 | Ogasawara | 336/182 |
| 7,379,291 | B2 | * | 5/2008 | Quazi | 361/674 |
| 7,623,018 | B2 | * | 11/2009 | Yang | 336/234 |
| 2004/0085174 | A1 | | 5/2004 | Decristofaro et al. | |

FOREIGN PATENT DOCUMENTS

| | | | |
|---|---|---|---|
| DE | 888429 | C | 8/1953 |
| DE | I703600 | U | 7/1955 |
| DE | 1905498 | A1 | 8/1970 |
| DE | 3008598 | A1 | 10/1981 |

OTHER PUBLICATIONS

PCT International Search Report for PCT/MY2008/000023 dated Dec. 4, 2008.

* cited by examiner

*Primary Examiner* — Mohamad Musleh
*Assistant Examiner* — Joselito Baisa
(74) *Attorney, Agent, or Firm* — Hamre, Schumann, Mueller & Larson, P.C.

(57) ABSTRACT

A ballast choke coil constructed with more than two winding coils assembled on laminate cores (LC) being held together firmly by a bracket (M1) in the manner of simulating the toroidal structure created more space for increasing the number of winding turn of the coil or alternatively allow for increase of wire size. Total number of winding turns that is needed to achieve the required inductance is divided to several coils. The new structure utilizes only half of the laminate material for producing a simple ballast choke coil unit that is similar performance to the existing fluorescent lamp ballast choke coil available in the market. Even though two units of coil (WC) are used in the construction of this ballast choke coil, the wire total weight that is used to produce a unit of ballast need not be increased.

19 Claims, 11 Drawing Sheets

| | Industrial Standard Reactance Type Choke Ballast for continuous 24 Hour Operation | |
|---|---|---|
| | Typical Conventional Design | Twin-Coil Design Serial Connection |
| Construction: | | |
| Laminates shape | U-T | U-U |
| U laminate leg size | 7 mm (D21) | 14.5 mm (D11) |
| T laminate leg size | 13.7 mm (D22) | Not Applicable |
| Laminate Thickness | 0.5 mm | 0.5 mm |
| Coil internal width | 14 mm (D24) | 16 mm (D14) |
| Coil internal length | 95 mm (D23) | 26 mm (D13) |
| Electrical Specification: | | |
| Inductance at 50Hz | 1.5 Henry | 1.7 Henry |
| Current at 240 Vac 50 Hz | 160 mA | 160 mA |
| Wire Resistance | 21 ~ 30 ohm | Less than 30 ohm |
| Material Used: | | |
| Laminate weight | 660 grams | 350 grams ( - 45% ) |
| Copper Wire | 115 grams | Less than 150 grams ( +30% ) |
| Bobbin | No Bobbin | 6 grams |
| Base bracket | 50 grams | 52 grams |
| Cover casing | No cover | 25 grams |
| | 825 grams | 583 grams |

Fig. 25

| | House-hold used Reactance Type Choke Ballast | |
|---|---|---|
| | Typical Conventional Design | Twin-Coil Design Serial Connection |
| Construction: | | |
| Laminates shape | U-T | U-U |
| U laminate leg size | 7 mm (D21) | 12.7 mm (D11) |
| T laminate leg size | 13.7 mm (D22) | Not Applicable |
| Laminate Thickness | 0.5 mm | 0.5 mm |
| Coil internal width | 15.5 mm (D24) | 14.5 mm (D14) |
| Coil internal length | 46 mm (D23) | 20 mm (D13) |
| Electrical Specification: | | |
| Inductance at 50Hz | 1.5 Henry | 1.6 Henry |
| Current at 240 Vac 50 Hz | 145 mA | 140 mA |
| Wire Resistance | 70 ~ 95 ohm | Less than 60 ohm |
| Material Used: | | |
| Laminate weight | 350 grams | 210 grams ( - 40% ) |
| Copper Wire | 42 grams | Less than 45 grams ( +8% ) |
| Bobbin | No bobbin | 4 grams |
| Base bracket | 28 grams | 38 grams |
| Cover casing | No cover | 20 grams |
| | 420 grams | 317 grams |

Fig. 26

MULTIPLE COILS FLUORESCENT LAMP BALLAST

1. TECHNICAL FIELD OF THE INVENTION

The present invention relates generally to a device for lighting up fluorescent lamp tube lighting by means of employing plurality winding coils stacks in a single unit of ballast choke coil device.

2. BACKGROUND OF THE INVENTION

At present the fluorescent tube lighting ballast choke coil consists of a single winding coil encapsulated with silicon steel laminates in the shape of butterfly; by means of U-T laminate cores. However, due to the existing commonly used fluorescent lamp tube lighting casing design, the size of the coil is restricted and the capacity of the ballast depend solely on the amount of silicon steel laminates that are stuffed into a unit of ballast. Wire length is longer when stuffing in more laminates but number of turn can not be increased due to space constraint and that is a waste of wire material and resulted in waste of energy as longer wire also mean that the resistance is higher and the result is energy loss as more heat is generated. Additional copper or aluminium wire length that is not used to increase the number of winding turns become a burden to the ballast unit that cause its performance to be inefficient.

The new design is focusing on any increase of metallic wire such as copper or aluminium wire is used to increase the winding turns thereby increases the ballast inductance. This new design concept consists of a round loop of laminates with single or plurality air gaps. This new design construction would require less laminate materials and more wire winding turns can be added onto the ballast unit compare to the similar size of present ballast available in the market. Larger wire diameter size can be used as more space is available which will improve the ballast performance with lower heat lost generation.

In view of the fact that raw material like copper and aluminium that is used to produce wire are getting more scarce; many ballast manufacturer has resort to using smaller wire diameter in order to reduce manufacturing cost. This has cause more heat generation and the ballast unit has shorter life span. As a result, damaged ballast generates higher rate of scrap metal. Hence, the present invention will address the shortcoming of available inventions in a sense that a new concept of design structure for the fluorescent tube lighting application of reactance type ballast that require less material would be eminence.

3. SUMMARY OF THE INVENTION

Accordingly, it is the primary aim of the present invention to provide a multiple coiled fluorescent lamp ballast wherein the ballast construction is improvised in order to provide better performance.

It is yet another object of the present invention to provide a multiple coiled fluorescent lamp ballast that is able to utilize any excess of copper or aluminium wire to increase the winding turns thereby increasing the ballast inductance.

It is yet another object of the present invention to provide a multiple coiled fluorescent lamp ballast that is able to utilize larger wire diameter size to improve the ballast performance with lower heat lost.

It is yet another object of the present invention to provide a multiple coiled fluorescent lamp ballast comprising mainly a round loop of laminates with air gap(s) and coupled with two or more coils which require less laminate materials and more wire winding turns can be added onto the ballast unit.

Other and further objects of the invention will become apparent with an understanding of the following detailed description of the invention or upon employment of the invention in practice.

According to a preferred embodiment of the present invention there is provided,

A fluorescent lighting ballast choke coil device comprising, at least a pair of laminated cores stacks (LC);

at least a pair of winding coils (WC);

characterized in that said laminated cores (LC) comprises two or more stacks of multi-layers of laminates being inserted into two or more winding coils (WC) to form a complete loop for magnetic flux to flow with the concept that all coil stacks are activated simultaneously with the rules of all coils inducing magnetic flux in unidirectional flow.

In another aspect, the present invention provides,

An assembly housing for ballast choke coil device comprising, at least a top cover (M1);

at least a base plate (M2);

characterized in that said cover (M1) is designed with flanges construction to hold the laminate core stacks assembly.

4. BRIEF DESCRIPTION OF THE DRAWINGS

Other aspect of the present invention and their advantages will be discerned after studying the Detailed Description in conjunction with the accompanying drawings in which:

FIG. 1 illustrates a perspective upside-down view of an embodiment of the present invention of ballast assembly.

FIG. 2 to FIG. 8 demonstrates the possible matching shapes of the laminated cores stacks.

FIG. 9 displays a schematic diagram of a simple bobbin coil.

FIG. 25 shows a table on details of comparison between typical industrial standard conventional ballast to a Twin-Coil Ballast.

FIG. 26 shows a table on details of comparison between typical low cost conventional ballast to a Twin-Coil Ballast.

5. DETAILED DESCRIPTION OF THE DRAWINGS

In the following detailed description, numerous specific details are set forth in order to provide a thorough understanding of the invention. However, it will be understood by those of ordinary skill in the art that the invention may be practiced without these specific details. In other instances, well known methods, procedures and/or components have not been described in detail so as not to obscure the invention.

The invention will be more clearly understood from the following description of the embodiments thereof, given by way of example only with reference to the accompanying drawings, which are not drawn to scale.

Figure 1:
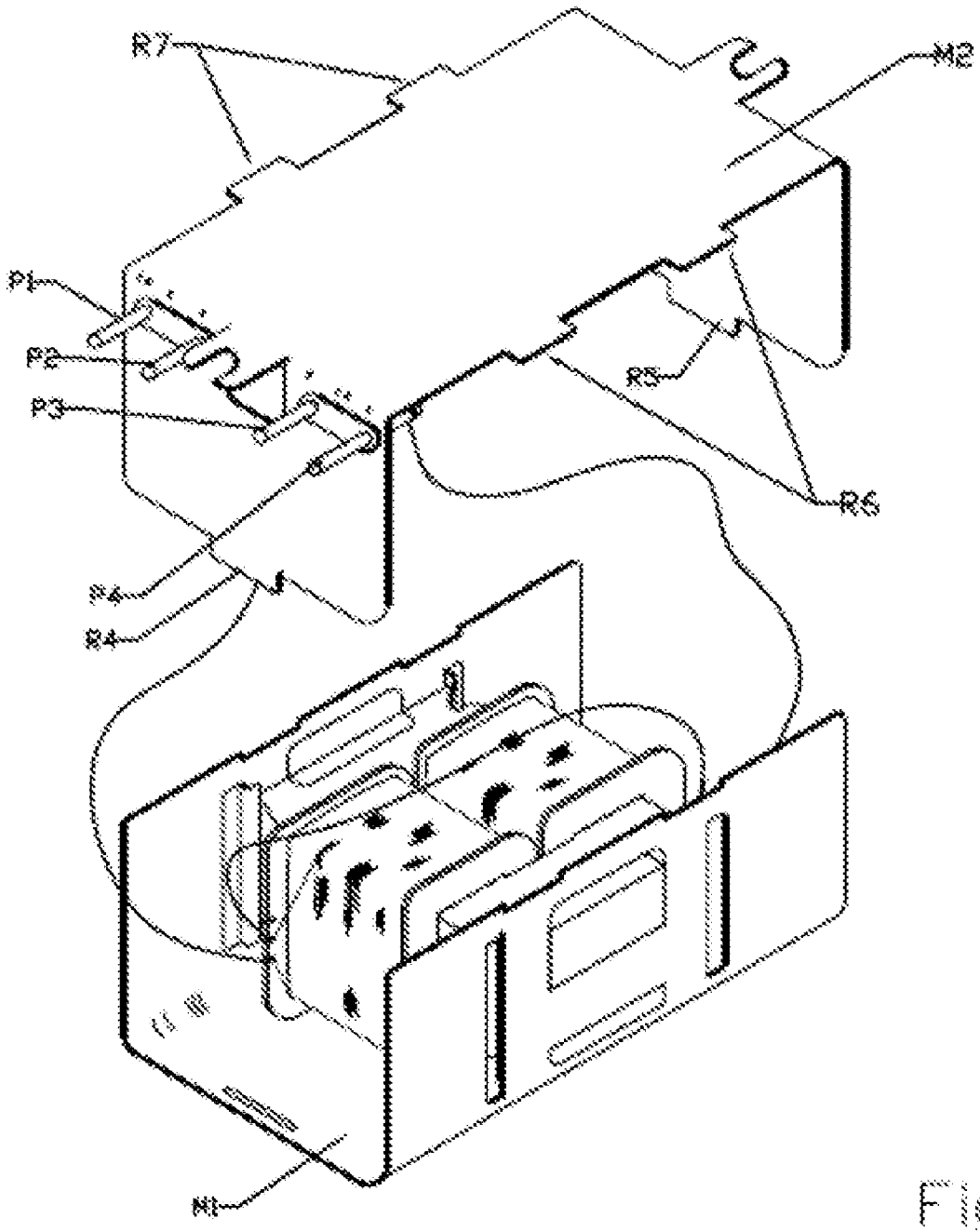

Referring to FIG. 1, there is shown a perspective upside-down view of an embodiment of the present invention of ballast assembly design, which comprises of at least a pair of laminated cores stacks (LC) and at least a pair of winding coils (WC) wherein said laminated cores (LC) comprises of two or more sets of multi-layered laminated cores being inserted into two or more winding coils (WC) and the laminates being held by cover which has multiple clamping flanges (R4, R5, R6 & R7) on bottom plate (M2) and caulking flanges on top cover (M1).

Figure 2:
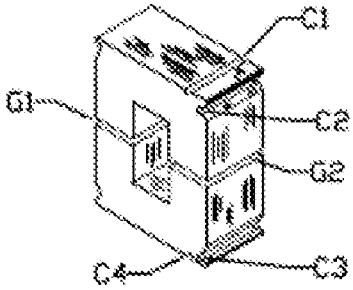
Figure 3:
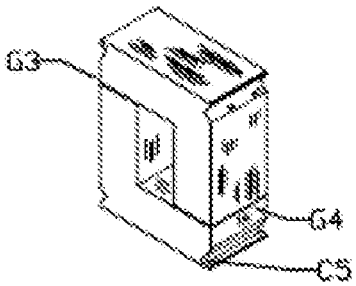
Figure 4:
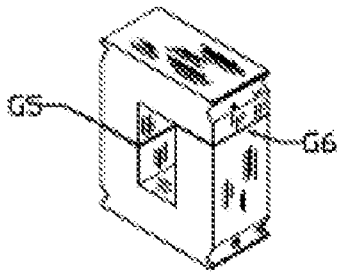
Figure 5:
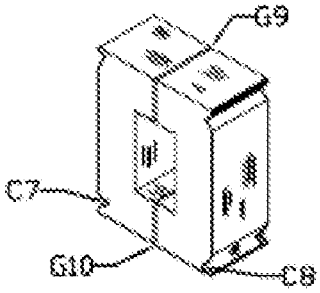
Figure 6:
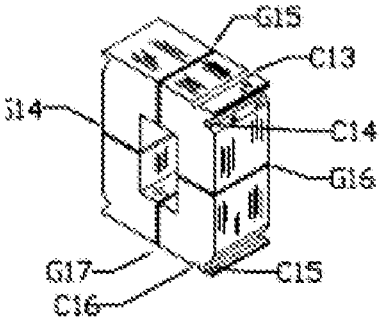
Figure 7:
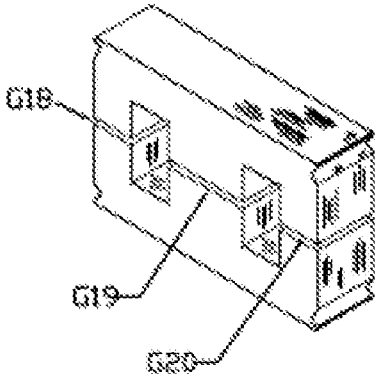
Figure 8:
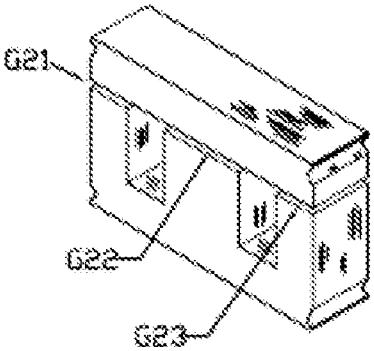

The multi-layered laminated cores (LC) construction has a few possible shapes combination, as illustrated in FIG. 2 to FIG. 8. For example, FIG. 2 is U-U shaped; FIG. 3 is L-L shaped; FIG. 4 is L-J shaped; FIG. 5 is C-C; FIG. 6 is L-L-L-L shaped, FIG. 7 is E-E shaped and FIG. 8 is I-E shaped. The laminated cores (LC) are packs of a plurality of thin layers of silicon steels that have high permeability. The silicon steel laminate thickness is 0.5 millimeter in normal cases. However, thicker silicon steel laminate is also possible to be used but would probably has poorer result. Thinner laminate is good but increases production cost. In the case of laminated cores (LC) construction in FIG. 7 and FIG. 8, three coils (WC) are used for the ballast to operate. The corners of the laminate (LC) can be of right angle or cut in curving shape of round edges. Cutting grooves (C1 to C16) are meant for laminate stacks (LC) orientation identification marking. For example the FIG. 2 of U-U shape comprises of a single U stack with one leg shorter than the other such that when both stacks orientation marking are placed on the same side during matching, the shorter leg of the U stacks meet each other and created an air gap. Thus the U-U laminate stacks (LC) will form a mirror image for the other. Cutting groves such as C1 preferably is on the side that the leg that is longer so that it can serves the secondary objective of allowing denting process of the housing bracket at this location in order to hold the laminate stacks (LC) more firmly. In addition to this, the identification of the laminates stacks (LC) orientation can be conducted by using of cutting the crimping grooves on the laminate (LC) in an offset manner or two crimping grooves with different shape such as the cutting groove C1 to C16 The orientation of laminate identification should be easy to be identified by means of including but not limited to naked eye visual differentiable shape, mechanical jig identification or electronic sensing method on the laminate or by means of offset embossed shape on the laminate during assembly is necessary to achieve the objective of creating an desirable air gap between the shorter leg of the mating laminates stacks (LC).

The laminated cores (LC) are being inserted into two or more pre-wound coils (WC), be it air coils or bobbin coils. The schematic diagram of a simple bobbin coil is displayed in FIG. 9, in which the start terminal (ST) of the winding and the end terminal (ET) of the wire on the coil (WC) can be connected together in the manner of serial connections or parallel connections.

Figure 19:
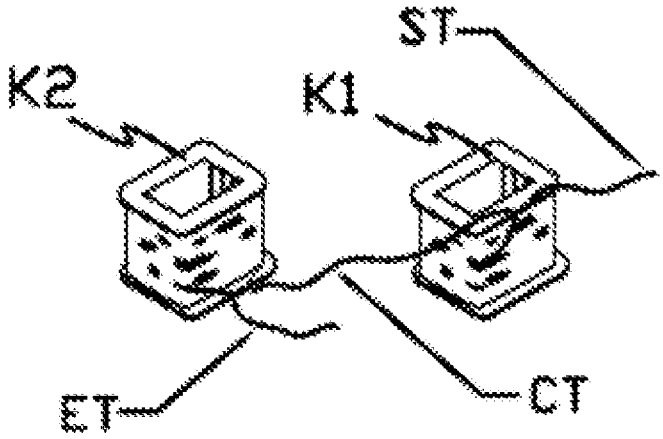
FIG. 19 shows a schematic diagram of a pair of coil stacks with wire terminal between individual coil stacks.
Figure 20:
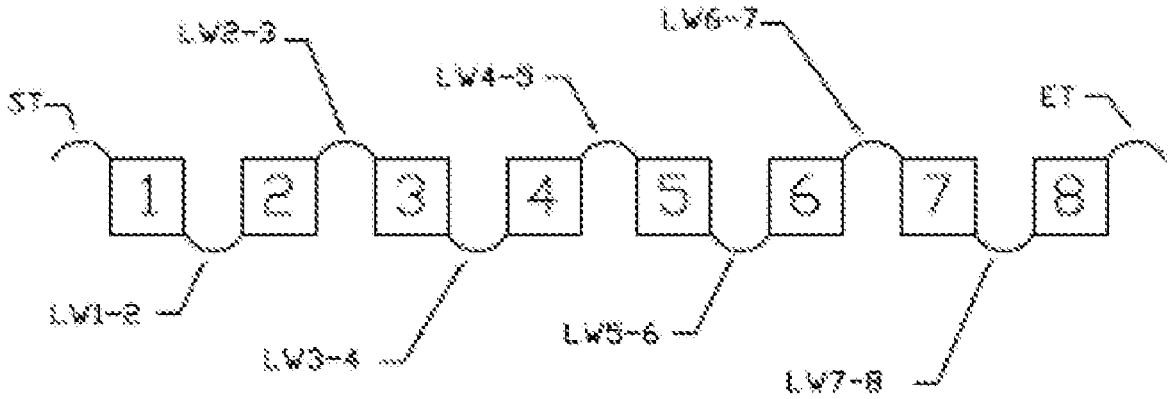
FIG. 20 shows a schematic diagram of a plurality of coils with link wire between individual coil stacks.

Referring now to FIG. 19, there is shown a schematic diagram of the multiple centre tapped terminals bobbin coils. The center tapped terminals CT or link wire between winding coils can be of multiple tapped out of two or more center tapped terminals as in FIG. 20 which are denote as LW1-2. LW2-3, LW3-4 and so on. For simple application, a single center tapped would be sufficient. The center taps may be for the purpose of reducing the number of turns that is used to operate the fluorescent lamp during light up period with lower start up current. An external device is required to cut off the connection of center tap after light up and uses full capacity of the ballast for optimum current consumption. FIG. 20 is an example of even number coils (WC) with serial connection wire terminals between individual coil stacks (WC). ST denotes the start wire terminal of the first coil and ET denotes the end wire terminal of the last coils. Winding process is wound to form the first coil and without breaking the wire, continue to wind the subsequent coil and so on until the desired quantity of coils stacks is completed. As shown in FIG. 20, LW1-2 is the link wire between coil stack 1 and coil stack 2 which is actually the end wire of the first coil and start wire of the second coil. The same goes to LW2-3, LW3-4 and so on. For the case of odd and even numbers of coils stacks (WC) for serial connection, it is straight forward as can be seen from the diagram that if the odd number of coil stacks (WC) is used in the design, for example says that 7 coil stacks is used, then LW7-8 will be the end wire terminal. Thus there is no need to interconnect the coils stack later during assembly as the link wire between the coils (WC) is readily available. In the case of two coils serial connection application, one coil is position in an upside-down orientation from the other coil given that the coils are wound in the same clockwise direction and leaving only two wire terminal whereby one wire terminal is connected to the Live connection of the AC power source on and the other wire terminal being connected to the ballast lamp.

However, in the case of parallel connection, the alternate link wires are interconnected between the coils stacks (WC) such as joining up the start wire of the first coil to link wire between second coil to the third coil and link wire between forth coil to fifth coil and so on to form a single terminal connection. The link wire between first coil to the second coil and link wire between third coil to the forth coil and so on are joined up to form a second single terminal connection. The link wires between the coils stacks (WC) are interconnected to the start wire of the first winding and the end wire of the last winding giving that an even number of winding coils stacks (WC) are used. However, it shall not be done on the end wire of the last winding coil stack giving that an odd number of winding coils stacks (WC) are used. In the case of odd number of winding coils stacks (WC) are used, the end wire of the last coil stack shall be interconnected to the link wire of the first coil to the second coil. For the example of 8 coils stack design assembled on 8 legs laminate core stack, then all wire terminals that are drawn on the upper side such as ST, LW2-3, LW4-5, LW6-7 and ET shall be link up and the drawn lower side terminal LW1-2, LW3-4, LW5-6 and LW7-8 shall be link up. There shall be ultimately only two effective terminals from the coils that is one terminal connected to the AC current and the second terminal connected to the fluorescent tube lamp.

Figure 9:
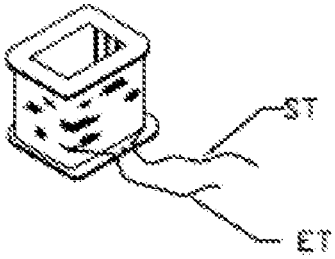

Thus, all coils (WC) would ultimately act as a single coil and create a single direction of magnetic flux flow in the laminate loops. Referring now to FIG. 9 and FIG. 19, there are illustrated only the coils (WC) of enameled magnetic wire with bobbin. The coil (WC) also can be produced without bobbin that is an air coil, by means of using self-bonding wire wound on mandrel and then cure by heat or solvent.

Figure 10:
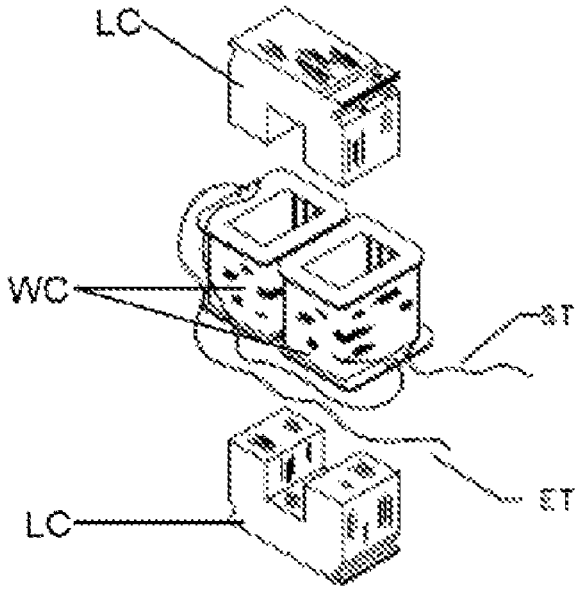
FIG. 10 illustrates the assembly of two coils with two stacks of U-U shaped multi-layered laminated cores.
Figure 11:
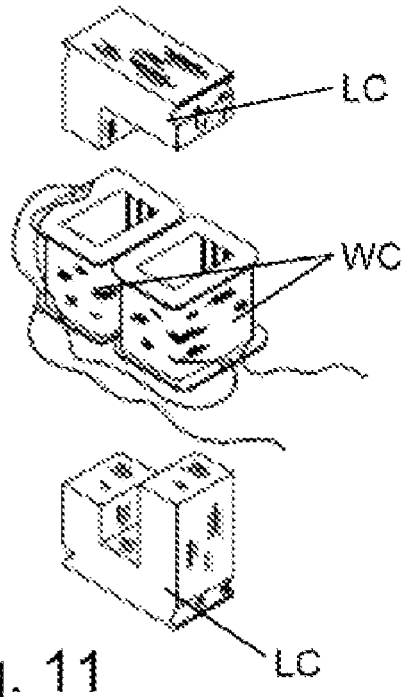
FIG. 11 illustrates the assembly of two coils with two stacks of L-J shaped multi-layered laminated cores.
Figure 12:
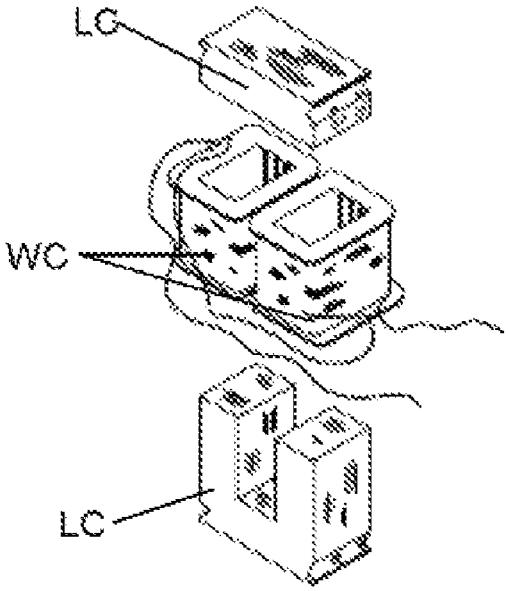
FIG. 12 illustrates the assembly of two coils with two stacks of I-U shaped multi-layered laminated cores.
Figure 13:
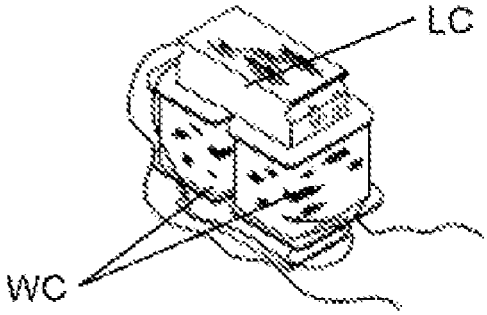
FIG. 13 shows a schematic view of a semi-finished ballast assembly.
Figure 14:
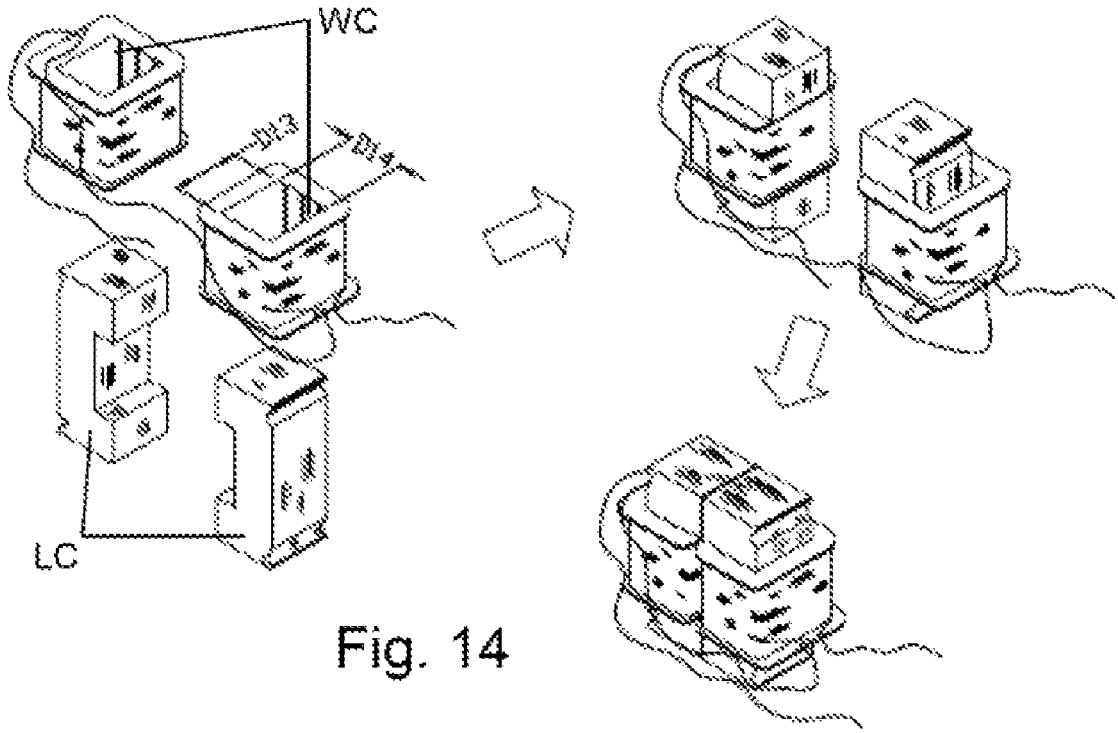
FIG. 14 illustrates the assembly of two coils with two stacks of C-C shaped multi-layered laminated cores.
Figure 15:
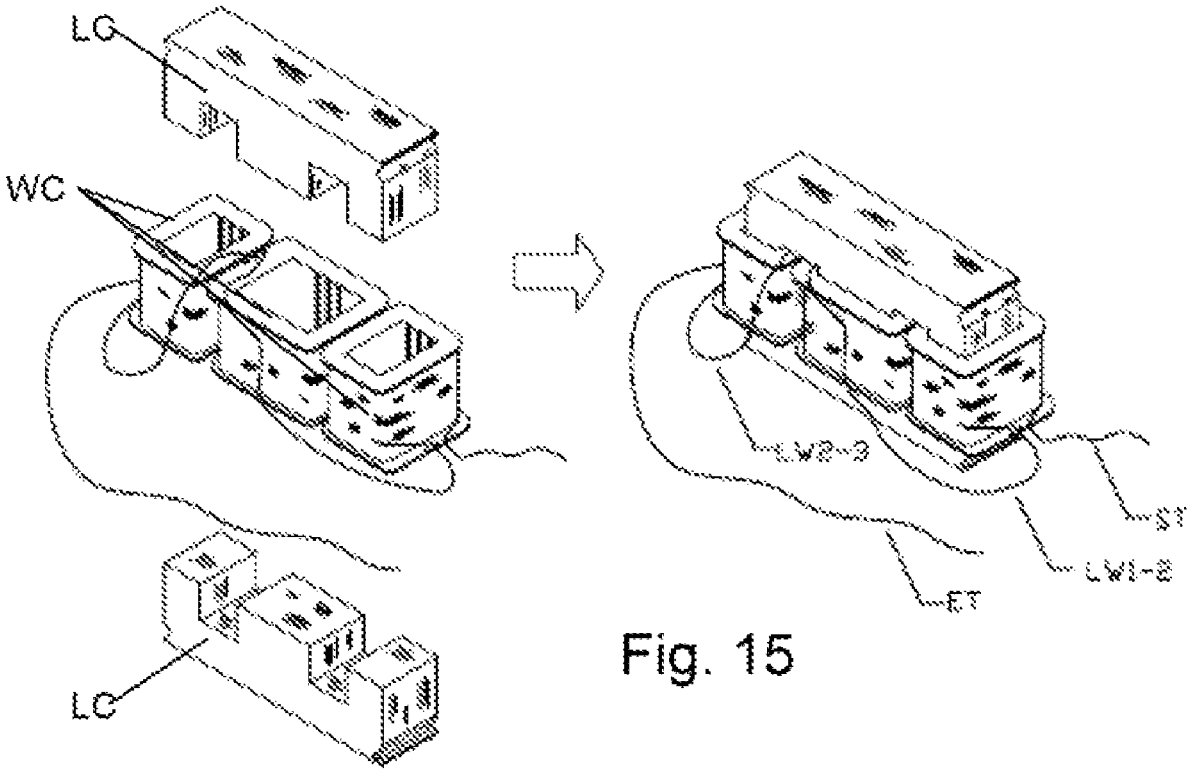
FIG. 15 illustrates the assembly of three coils with two stacks of E-E shaped multi-layered laminated cores with one air gap at the centre of the middle coil for best performance.

Referring to FIGS. 10, 11, 12 and 14 there is shown the assembly of two coils (WC) with two stacks of different shapes of multi-layered laminated cores (LC) which may be applicable in this invention. For instance, FIG. 10 is U-U shaped; FIG. 11 is L-J shaped; FIG. 12 is I-U shaped and FIG. 14 is C-C shaped. Whilst FIG. 15 illustrates the assembly of three coils (WC) with two stack of F-F shaped multi-layered laminated cores (LC) with one air gap at the centre of the middle coil (WC) for best performance. The two sets of multi-layer laminates (LC) forms a complete loop for magnetic flux to flow, with one or more than one air gap on the laminates looping. This is based on the concept that all coil stacks are activated simultaneously with the rules of all coils inducing magnetic flux in unidirectional flow. The air gap is important to prevent magnetic saturation of the cores. There may be two air gaps at both meeting point of the two sets of laminates; or one side meeting each other tightly and create only one air gap on the other side of meeting laminates. The air gap size range from 0.1~0.8 millimeter. However in most cases, a single air gap of size 0.3~0.5 millimeter is already sufficient to minimize such magnetic flux saturation. The air gap can be an empty air space or the laminate stacks being separated by a thin piece of non-ferrous metal or ferrous metal of non silicon steel material. Furthermore, the air gap(s) can be located at the center of the coil(s) or external area of the coil(s) on the laminate stacks matching assembly. The semi-completed assembly is then inserted into a casing, following by paint application onto the unit before a base plate is attached to it. The appearance of semi-finish ballast assembly is shown in FIG. 13.

Figure 16:
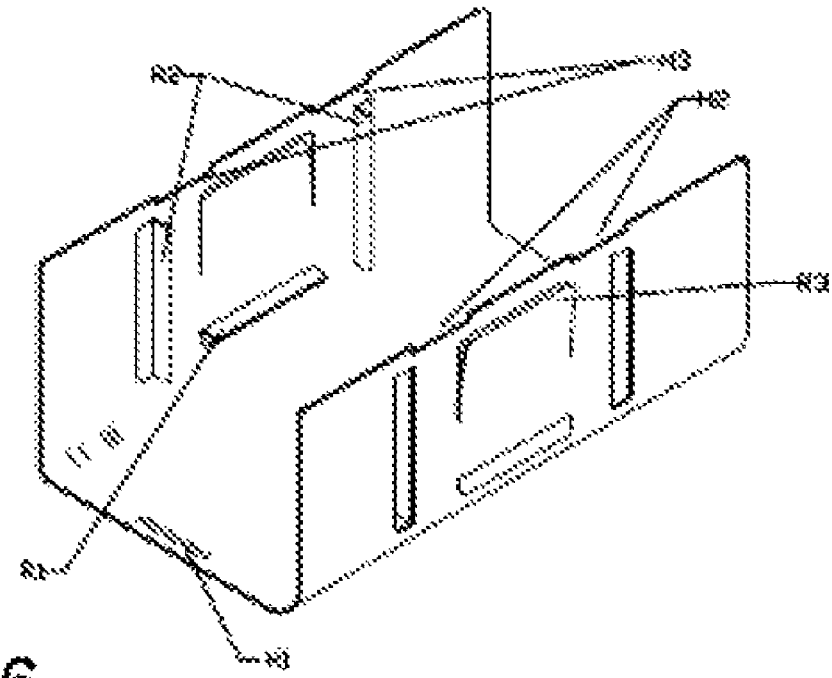
FIG. 16 shows a schematic view of the ridges construction of both sides of the cover design to hold the semi-completed ballast assembly.

In another aspect, the present invention provides an assembly housing for ballast choke coil device. FIG. 16 shows a schematic view of the flanges construction of both sides of the cover design to hold the semi-completed ballast assembly. Flange (R3) has longer cut and slightly bent outward. The flange (R3) will be bended in after crimping during assembly. Holes (H1) and grooves (H2 & H3) are for crimping bottom plate to top cover. FIG. 18 shows another choice of alternative cover design whereas six flanges (R8) clamp onto base bracket of FIG. 17 and two flanges of R9 clamp through H4 holes and hiding the excess part underneath embossed areas (E1). Two to four terminal wires exit holes can be in the shape of H8 and or H9. Four cut out grooves (H10) of FIG. 18 on the corners of the bent cover and H6 of FIG. 17 are for assembly access purpose during crimping process or spot welding the flanges to the contacting part of the other part housing bracket.

The spot welding process can be achieved by inserting one part of welding rod through the four access hole area on the cover and four access holes area on the housing bracket and the other part of the pair of welding rod at the external part of the housing and allow analog current to pass through the housing surface in order to generate metal melting heat to bond the two metal surface together.

Mechanical noise created by the laminates is eliminated by various means such as laminate stacks being held firmly by punch out and bend thin flanges on the housing design on both side of the cover wall; being bottom piece of bent flanges for sitting placement of the laminate stacks; and side flanges for guiding laminate positioning and later crimped to hold the laminate stacks; and top flanges on both sides for crimping on the laminates stack of different thickness such that the laminates layers are tightly held to prevent the possible mechanical noise induced by laminate layers vibration.

Figure 17:
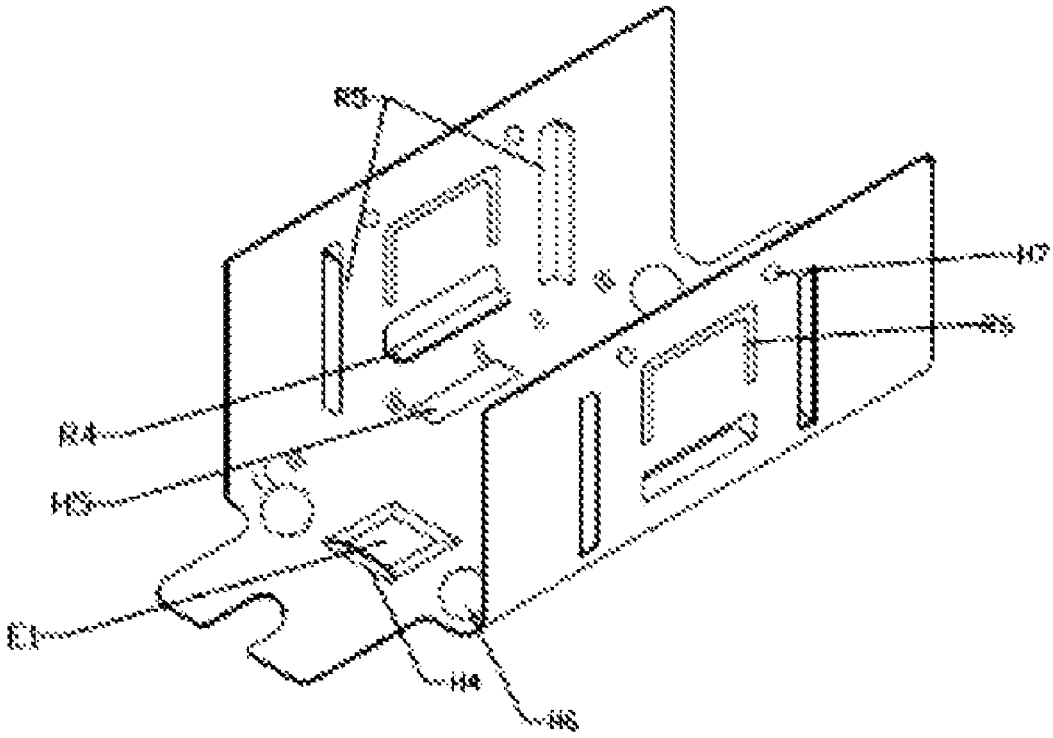
FIG. 17 shows a schematic diagram of another choice of possible casing design wherein the C channel is the base bracket.
Figure 18:
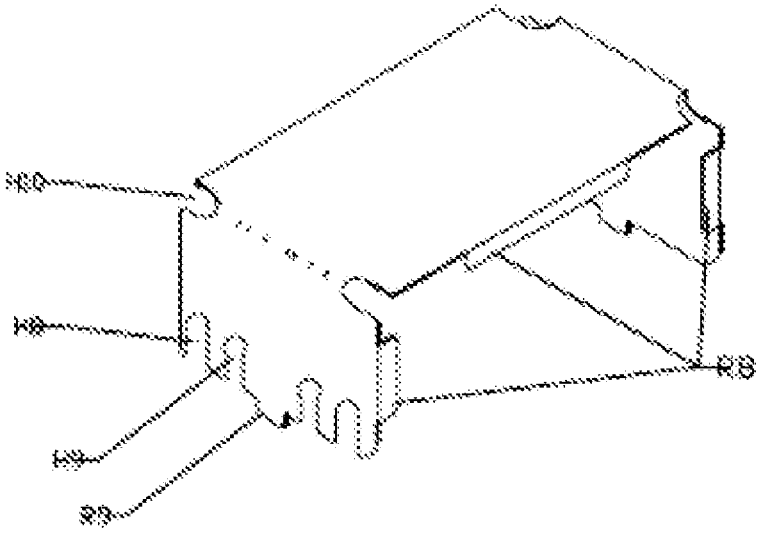
FIG. 18 shows a schematic diagram of another choice of possible cover design.

There is another choice of possible casing design wherein in this case the C channel is the base bracket as shown in FIG. 17. In this bracket design, alternative flanges design is also demonstrated. Flanges (R5) are punched out in the manner like opening a pair of window panel at the opposite direction than flanges (R2) in FIG. 16. Flanges (R4) is punched downward in the opposite direction to flange (R1) in FIG. 16. Flanges (R4 and R5) have identical mirror image features on the opposite side of the wall. Hence the bend corners that will have direct contact to the laminate stack do not have round edges. The flanges (R6) are formed by punching a C shape hole on both sides of the bracket walls. Two holes (H4) at two ends of the bracket is similar to H1 holes in FIG. 16; but the material at the side of the hole is deformed upward into an embossed shape (E1). Two holes (H5) and four holes (H6) are formed at the bottom. Four holes (H7) are formed such that link rods can be attached between the two walls to enhance the holding force of the walls. Holes (H6) are meant for the purpose of allowing access space during spot welding process of the housing brackets. Metal bars are inserted through H5 holes meant for supporting the bottom punch out bend flanges during crimping of the top bend flanges to hold down the laminate stacks. The inserted metal bars will be able to prevent excessive crimping force from further bending the bottom flanges. In addition, the other rattling sound caused by vibration between the mating stack is reduced by means cover piece that hold the two walls of the housing tightly. Holes (H7) are meant for the purpose of attaching metal rods that is screwed or reverted through two pairs of round holes (H7) on the housing in order to pull the two housing walls together more firmly. Preferably there is a small denting process on the housing wall at the position that touches the side at laminate stack that is with a half round cutting groove on the laminates in order to increase the pressing force from the housing wall on the laminate stacks. The denting embossed part at the housing wall shall provide a tighter force on the longer leg of the U laminate stacks that mate.

Figure 21:
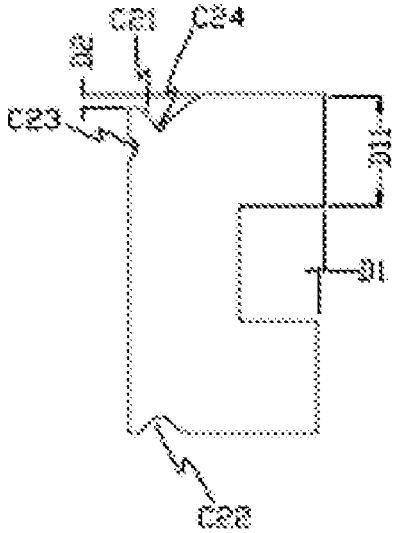
FIG. 21 shows more detail illustration of a single piece of U shape laminate design.

FIG. 21 shows a more detail description of FIG. 2 laminate (LC) design of a single piece of U shape offset laminate design that is not symmetry. The two legs of the laminate (LC) are different in their length that is distinguished by differential distance (D1). Cut out grooves (C21 and C22) are meant for clamping grooves purpose whereby the flanges of the housing bracket shall clamp onto these grooves. The groove (C21) is an offset manner that create differential distance (D2) such that the differential distance is distinguishable by the naked eye or when the laminate (LC) is placed on an assembly jig, there is no way that the laminated can be placed in wrong orientation. Other method of identifying the laminate (LC) orientation would be to have a cut out groove of C23 or C24.

Figure 22:
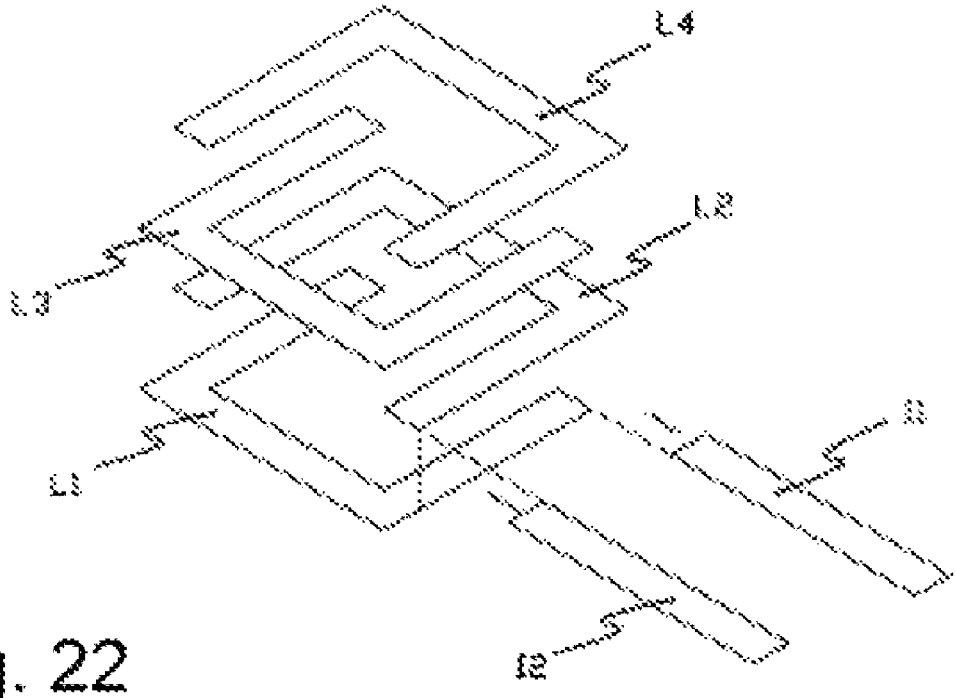
FIG. 22 to FIG. 24 shows existing available design of laminate arrangement for transformer and fluorescent lighting ballast.

FIG. 22 which is not part of this invention but merely for the purpose of differential illustration and distinguishing the new invention. This figure shows the laminate (LC) arrangement for a transformer with C-I or U-I shape in order to illustrate the difference between the new ballast designs that has plurality of coils (WC) from a transformer design. The aspect of the different in plurality coil wiring connection has been explained in earlier part. This figure illustrates a commonly practical industrial use method of arrangement for laminate (LC). First layer is L1 and I1 mate at the most bottom of the arrangement. L2 and I2 mate at the second level but at 180 degree rotation from first layer. All odd number layers such as layer three is of the same direction as the first layer and all even number layers such as layer four is of the same direction as the second layer. With this kind of orientation, the laminate achieve two key advantageous; one being minimized core loss and two being provide very rigid grip in between the laminate. However, in today application, some manufacturer has resort to not having the I-shape laminate in order to reduce the assembly time and material cost. But this structure is not suitable for fluorescent lighting application as the start up electric current and operating electric current can not be maintained at acceptable range without burning the fluorescent tube filament.

Figure 23:
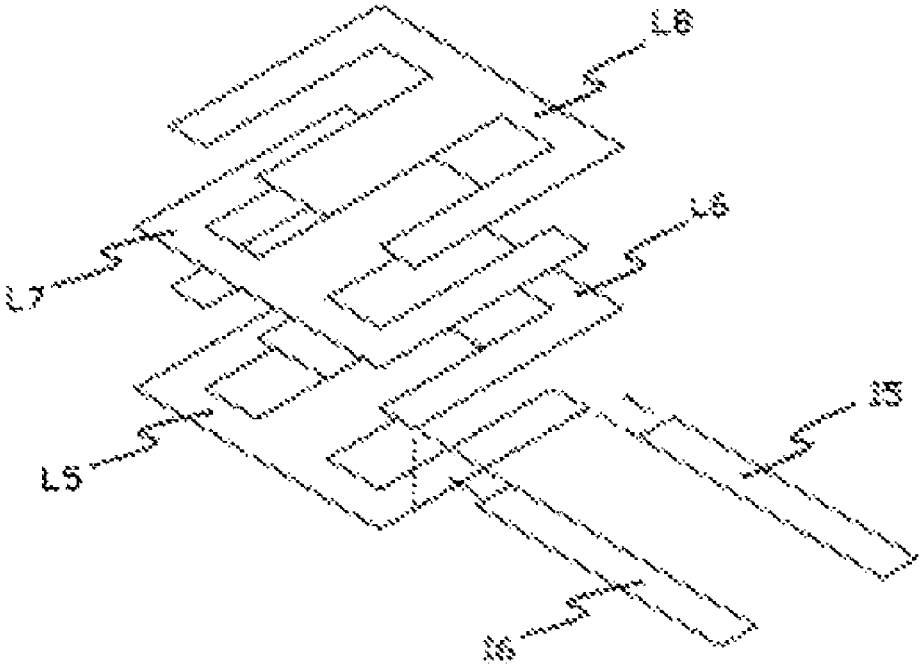

FIG. 23 which is not part of this invention but merely for the purpose of differential illustration and distinguishing the new invention. This figure shows the laminate arrangement for a transformer with E-I shape. Method of arrangement is similar to FIG. 20 illustration.

Figure 24:
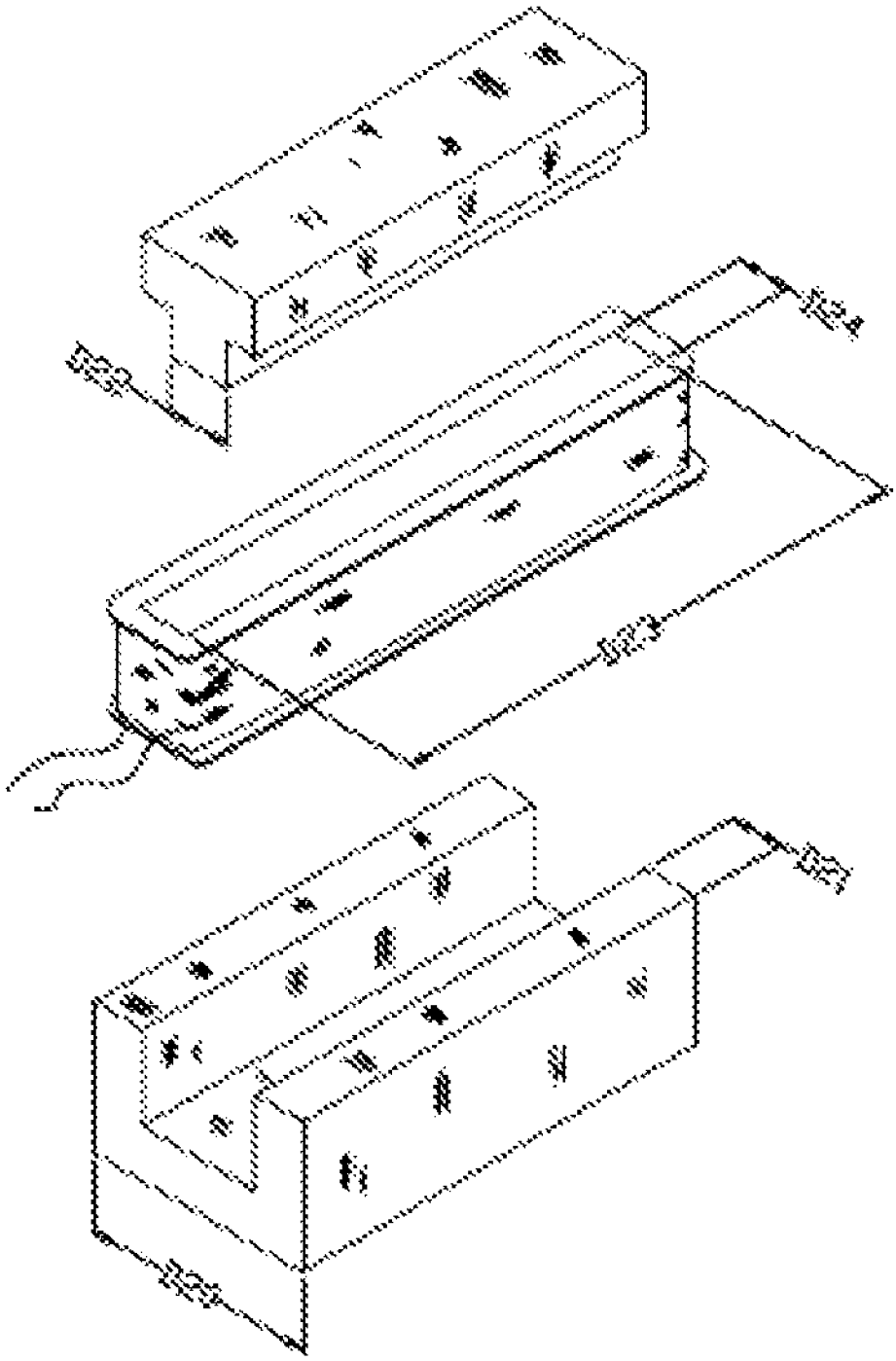

FIG. 24 which is not part of this invention but merely for the purpose of differential illustration and distinguishing the new invention. This figure shows typical component of conventional reactance type ballast for fluorescent lighting that utilizes U-T laminates core and a single rectangular coil stack (WC).

FIG. 25 contains details of comparison between typical industrial standard conventional ballast to a Twin-Coil Ballast. The materials type that are used to produce the conventional coil and the twin coils are the same. However it is clearly that the twin coil design demonstrates a more superior concept as it required much less materials as can be seen from the laminate weight usage and the ballast total weight. The internal coil dimension shows that the conventional design structure is rather narrow and long rectangular (14 mm×95 mm). On the other hand, the twin coil design is although also rectangular but the length is not so long thus form a shape that is more toward 'squares' shape (1.6 mm×26 mm). From the dimension, it is somewhat like dividing the single coil of conventional design into two separate coils with more number of turns on each coil.

FIG. 26 contains details of comparison between typical low cost conventional ballast to a Twin-Coil Ballast. In most of the third world country, many manufacturers have resorted to cutting cost on the metallic wire and less laminate materials. By reducing the laminate material and using smaller diameter of metallic wire on the conventional ballast, the obvious impact is on the resistance Rs is very high as much as 80 ohm. This is because the space constraint on the conventional design. When laminate material is reduced, the number of turns on the wire has to be increases; or else the coils will not be able to generate enough magneto force to induced required inductance to ignite the fluorescent tube. But because of space constrain within the laminate structure, the only way is to reduce the metallic wire diameter so that more turn can be stuffed inside the limited space. However, the new design for example the twin coil structure created more space to accommodate more number of turn of metallic wire. The new design has uses the structure of smaller internal cross section coil. Even though the number of turn has been increased, but the total weight of metallic wire is increased only by a small amount.

While the preferred embodiment of the present invention and its advantages has been disclosed in the above Detailed Description, the invention is not limited thereto but only by the spirit and scope of the appended claims.

What is claimed is:

1. A fluorescent lighting ballast choke coil device comprising, at least a pair of laminated core stacks;

at least a pair of winding coils;

said laminated core stacks comprises two or more sets of multi-layers of laminates being inserted into the winding coils to form a complete loop for magnetic flux to flow, all the winding coils are activated simultaneously by inducing magnetic flux in a unidirectional flow, wherein the laminated core stacks include a pair of U-U laminated cores, each of the U-U laminated cores has a U-shape and includes legs with an offset leg length, the U-U laminated cores have an orientation defined by an orientation mark including one or more cutting grooves on the laminates, the U-U laminated cores are positioned to form an air gap between one leg of one of the U-U laminated cores and one leg of another of the U-U laminated cores, and the pair of U-U laminated cores forms a complete full loop in a ballast device construction for magnetic flux flow within the laminates.

2. A fluorescent lighting ballast choke coil device as in claim 1, wherein the orientation mark is defined by first crimping grooves on the laminates with an offset or second crimping grooves with different shapes such that the offset or the different shapes are visible to naked eyes and a shorter leg of a single U laminated core of the U-U laminated cores is identifiable.

3. A fluorescent lighting ballast choke coil device as in claim 1, wherein the U shape is not a mirror image of one leg to the other leg of a single U laminate of the U-U laminated cores by means of one leg shorter than the other, and the orientation mark assists mating the U-U laminated cores, a shorter leg of one of the laminated core meets a shorter leg of the other laminated core thus the U-U laminated cores form a mirror image of each other.

4. A fluorescent lighting ballast choke coil device as in claim 1, wherein the orientation mark is identifiable by means of visual shape differentiable with naked eyes on at least one of the laminates, a mechanical jig identification on at least one of the laminates, or an electronic sensing method on at least one of the laminates or by means of an offset embossed shape on at least one of the laminates for creating the air gap between shorter legs of the U-U laminated cores.

5. A fluorescent lighting ballast choke coil device as in claim 1, wherein the winding coils with equal number of winding coils and laminate legs, have coils terminals interconnected together in a serial connections or a parallel connections such that all the winding coils ultimately act as a single winding coil as a whole when an electric current is passing through the winding coils at a particular point in time in a unit of the ballast choke coil device, and thus all the winding coils create a single direction of magnetic flux flow in laminate loops.

6. A fluorescent lighting ballast choke coil device as in claim 5, wherein for a serial connection application with two winding coils, one of the winding coils is positioned in an upside-down orientation from the other winding coil when the winding coils are wound in the same clockwise direction and leaving two wire terminals whereby one wire terminal is connected to an AC power source en and the other wire terminal being connected to a ballast lamp.

7. A fluorescent lighting ballast choke coil device as in claim 5, wherein a first winding coil is formed; and without breaking the wire, continue to wind the subsequent winding coils until a desired quantity of the winding coils is completed, and thus there is no need to interconnect the winding coils later during an assembly as a link wire between the winding coils is already readily available resulted in a ready serial connection of the winding coils.

8. A fluorescent lighting ballast choke coil device as in claim 5, wherein the parallel connection is achieved by interconnecting alternate link wires between the winding coils and joining up a start wire of a first winding coil to a link wire between a second winding coil and a third winding coil and a link wire between a fourth winding coil and a fifth winding coil to form a single terminal connection, whereas a link wire between the first winding coil and the second winding coil and a link wire between the third winding coil and the fourth winding coil are joined up to form a second single terminal connection.

9. A fluorescent lighting ballast choke coil device as in claim 8, wherein the link wires between the winding coils are interconnected to the start wire of the first winding coil and an end wire of a last winding coil when an even number of winding coils is used, and an interconnection is not present on the end wire of the last winding coil when an odd number of winding coils is used.

10. A fluorescent lighting ballast choke coil device as in claim 9, wherein in the case when an odd number of winding coils is used, the end wire of the last winding coil is interconnected to the link wire of the first winding-coil to the second winding coil.

11. A fluorescent lighting ballast choke coil device as in claim 1, wherein the winding coils has an orientation that is arranged such that only a single direction magnetic flux is induced at a particular point of time.

12. An assembly comprising, a ballast choke coil device comprising:

at least a pair of laminated core stacks;

at least a pair of winding coils; and the laminated core stacks comprise two or more sets of multi-layers of laminates being inserted into the winding coils to form a complete loop for magnetic flux to flow, all the winding coils are activated simultaneously by inducing magnetic flux in a unidirectional flow; and an assembly housing for the ballast choke coil device, the assembly housing comprising:

at least a top cover;

at least a base plate;

wherein the laminated core stacks include a pair of U-U laminated cores, each of the U-U laminated cores has a U-shape and includes legs with an offset leg length, the U-U laminated cores have an orientation defined an orientation mark including one or more cutting grooves on the laminates, the U-U laminated cores are positioned to create an air gap between one leg of one of the U-U laminated cores and one leg of another of the U-U laminated cores, the pair of U-U laminated cores forms a complete full loop in a ballast device construction for magnetic flux flow within the laminates, and wherein said top cover includes flanges to hold the laminated core stacks.

13. An assembly as in claim 12 wherein a spot welding process is achieved by inserting one part of a welding rod through an area with four access holes on the top cover and an area with four access holes on the base plate and another part of the welding rod at an external part of the housing to allow analog current to pass through a surface of the housing in order to generate metal melting heat to bond two metal surfaces together.

14. An assembly as in claim 13, wherein the flanges include bottom flanges and two side flanges, the bottom flanges are bent downward and the two side flanges are bent in a direction for opening a pair of window panels, such that bend corners that have a direct contact to the laminated core stacks do not have round edges.

15. An assembly as in claim 14, wherein other rattling sound caused by vibration between the laminated core stacks is reduced by means of a cover piece that holds two walls of the housing tightly and additional metal rods that are screwed or reverted through two pairs of round holes on the housing above the flanges are added to pull the two walls of the housing together firmly.

16. An assembly in claim 12, wherein the flanges include thin flanges, bottom flanges, side flanges, and top flanges, mechanical noise created by the laminates is eliminated by the thin flanges on both sides of the housing that are punched out and bent to firmly hold the laminated core stacks, by the bottom flanges that are bent for sitting placement of the laminated core stacks, by the side flanges that are crimped for guiding laminate positioning to hold the laminated core stacks, and by the top flanges on both sides of the housing for crimping on the laminated core stacks of different thickness such that the laminates are tightly held to prevent the possible mechanical noise induced by vibration.

17. An assembly as in claim 16, wherein a denting embossed part is disposed on a housing wall at a position that touches the side of the laminated core stacks that is with a half round cutting groove on the laminates to increase a pressing force from the housing wall on the laminated core stacks, and the denting embossed part at the housing wall provides a tighter force on a longer leg of the U-U laminated cores.

18. An assembly as in claim 12, wherein the flanges include bottom flanges and top flanges, a bottom area with access holes is directly below the bottom flanges that are punched out and bent, the bottom area is for a bottom metal bar to be inserted through the holes to support the bottom flanges during crimping of the top flanges that are bent to hold down the laminated core stacks; the inserted metal bars are able to prevent excessive crimping force from further bending the bottom flanges.

19. A fluorescent lighting ballast choke coil device comprising, at least a pair of laminated core stacks;

at least a pair of winding coils; and the laminated core stacks comprise two or more sets of multi-layers of laminates being inserted into the winding coils to form a complete loop for magnetic flux to flow, all the winding coils are activated simultaneously by inducing magnetic flux in a unidirectional flow, wherein the winding coils with equal number of winding coils and laminate legs, have coil terminals interconnected together in a serial connection or a parallel connection such that all the winding coils ultimately act as a single winding coil as a whole when an electric current is passing through the winding coils at a particular point in time in a unit of the ballast choke coil device, and thus all the winding coils create a single direction of magnetic flux flow in laminate loops, and wherein the parallel connection is achieved by interconnecting alternate link wires between the winding coils and joining up a start wire of a first winding coil to a link wire between a second winding coil and a third winding coil and a link wire between a fourth winding coil and a fifth winding coil to form a single terminal connection, whereas a link wire between the first winding coil and the second winding coil and a link wire between the third winding coil and the fourth winding coil are joined up to form a second single terminal connection.

* * * * *